US007950414B2

(12) United States Patent
Suzuki et al.

(10) Patent No.: US 7,950,414 B2
(45) Date of Patent: May 31, 2011

(54) REGULATING CHECK VALVE AND FUEL INJECTON VALVE HAVING THE SAME

(75) Inventors: Takashi Suzuki, Chiryu (JP); Kouichi Mochizuki, Anjo (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 215 days.

(21) Appl. No.: 12/364,549

(22) Filed: Feb. 3, 2009

(65) Prior Publication Data

US 2009/0242669 A1 Oct. 1, 2009

(30) Foreign Application Priority Data

Mar. 25, 2008 (JP) ..... 2008-077424

(51) Int. Cl.

| | |
|---|---|
| ***F16K 31/12*** | (2006.01) |
| ***F02M 59/00*** | (2006.01) |
| ***F02M 39/00*** | (2006.01) |
| ***F02M 61/20*** | (2006.01) |
| ***F02M 47/02*** | (2006.01) |
| ***B05B 1/30*** | (2006.01) |

(52) U.S. Cl. ..... 137/509; 239/533.2; 239/533.3; 239/533.9; 239/571; 239/572; 239/584; 239/90

(58) Field of Classification Search ..... 239/533.2, 239/533.3, 533.8, 533.9, 569, 570, 571, 572, 239/583, 584, 89, 90, 91; 251/337; 137/509
See application file for complete search history.

(56) References Cited

U.S. PATENT DOCUMENTS

| | | | | |
|---|---|---|---|---|
| 5,613,518 | A * | 3/1997 | Rakieski | 137/513.5 |
| 5,752,486 | A | 5/1998 | Nakashima et al. | |
| 6,019,115 | A * | 2/2000 | Sanders | 137/10 |
| 6,067,963 | A * | 5/2000 | Oi et al. | 123/458 |
| 6,427,714 | B2 * | 8/2002 | Freigang et al. | 137/225 |
| 7,140,386 | B2 * | 11/2006 | Avis et al. | 137/504 |
| 7,246,607 | B2 * | 7/2007 | Burke et al. | 123/516 |
| 2006/0163378 | A1 * | 7/2006 | Magel | 239/88 |

FOREIGN PATENT DOCUMENTS

| | | |
|---|---|---|
| JP | 2000-110690 | 4/2000 |
| JP | 2004-027966 | 1/2004 |
| JP | 2006-214317 | 8/2006 |

OTHER PUBLICATIONS

Japanese Office Action dated Feb. 9, 2010 issued in corresponding Japanese Application No. 2008-077424, with English translation.

* cited by examiner

*Primary Examiner* — Jason J Boeckmann
*Assistant Examiner* — Ryan Reis
(74) *Attorney, Agent, or Firm* — Nixon & Vanderhye PC

(57) ABSTRACT

A valve chamber is defined in a valve body of the regulating check valve. A first communicating hole and a second communicating hole communicate the valve chamber with a first flow passage and with a the second flow passage, respectively. A valve element is slidably installed in the valve chamber to seat on or lift away from a valve seat to close or open the first communicating hole. A pressure in the first flow passage urges the valve element away from the valve seat, and a pressure in the second flow passage urges the valve element toward the valve seat. The spring is interposed between the valve element and the valve body to urge the valve element away from the valve seat.

6 Claims, 7 Drawing Sheets

$P_2 \leqq P_1$ $P_2 > P_1 \cap (P_2 - P_1) > -K \cdot X/A$ $P_2 > P_1 \cap (P_2 - P_1) \leqq -K \cdot X/A$

REGULATING CHECK VALVE AND FUEL INJECTON VALVE HAVING THE SAME

CROSS REFERENCE TO RELATED APPLICATION

This application is based on and incorporates herein by reference Japanese Patent Application No. 2008-077424 filed on Mar. 25, 2008.

BACKGROUND OF THE INVENTION

1. Field of the Invention

The present invention relates to a regulating check valve that is used in high-pressure equipment and also relates to a fuel injection valve that has the regulating check valve and injects high-pressure fuel into an internal combustion engine.

2. Description of Related Art

It has been demanded in recent years that fuel injection valves for injecting high-pressure fuel into internal combustion engines adjust fuel injection quantity with quite high accuracy and respond promptly to control commands. This is for reducing emissions in the combusted exhaust gas and for improving gas mileage, from the standpoint of environmental protection. To these demands for improving the accuracy of the fuel injection operation and the response of the fuel injection valve, various fuel injection valves that are driven by piezoelectric actuators are proposed. The fuel injection valve driven by the piezoelectric actuator can generate a large force and has a fine response with respect to a conventional fuel injection valve driven by a solenoid.

JP2006-214317A discloses a fuel injection valve in which a needle slides in a fuel injection valve body in its axial direction. The needle has a tip portion, which opens an injection hole to an injection pressure passage or closes the injection hole from the injection pressure passage, and a large-diameter base portion, which is formed on an opposite side of the tip portion. A step surface on one axial end of the large-diameter portion is exposed to a control pressure chamber. A piezoelectric actuator moves a pressurizing piston to make fuel pressure in the control pressure chamber larger than fuel injection pressure. Thereby, the needle is pushed upward to open the injection hole to the injection pressure passage. The other axial end of the large-diameter portion is exposed to a back pressure chamber. The back pressure chamber is opened to the injection pressure passage.

In such a fuel injection valve, the piezoelectric actuator extends when it receives an injection signal, and the fuel pressure in the control pressure chamber increases in accordance with a displacement of the pressurizing piston that is moved by the piezoelectric actuator. Thereby, the needle is pushed upward by the fuel pressure in the control pressure chamber, and the injection hole is opened to start fuel injection. A distal end surface of the pressurizing piston is exposed to a piston chamber that is communicated to the injection pressure passage and to the back pressure chamber via a check valve. When the fuel injection is performed, the check valve closes to maintain increased fuel pressure in the control pressure chamber and to prevent a backflow of the fuel from the control pressure chamber into the back pressure chamber. After the fuel injection is stopped, the check valve opens to supply the fuel from the injection pressure passage to the control chamber because the fuel in the control chamber decreases due to fuel leakage at a sliding surface of the large-diameter portion.

JP9-170514A corresponding to U.S. Pat. No. 5,752,486 discloses a technique for inhibiting pulsations of fuel pressure in a fuel passage between a common rail and fuel injection valves. In this technique, a narrow passage is provided at a point where the common rail and the fuel passage is connected, to inhibit the pulsation of the fuel pressure due to propagation of water hammer that is caused by discharges of high-pressure fuel from a high-pressure supply pump and/or by injections of the high-pressure fuel from fuel injection valves.

However, in such a fuel injection valve as disclosed in JP2006-214317A, the control pressure chamber is communicated to the injection pressure passage and to the back pressure passage via the check valve having a conventional construction. Therefore, while the fuel pressure in the control pressure chamber is larger than the fuel pressure in the injection pressure passage and in the back pressure chamber, the check valve keeps closing, to prevent the backflow of the fuel from the control pressure chamber to the back pressure chamber. If the fuel pressure abruptly drops just after the fuel injection, valve-closing pressure acting on a rear surface of the needle can become relatively smaller than the fuel pressure in the control pressure chamber. Accordingly, even though the piezoelectric actuator is not driving, the needle can be pushed upward in a valve-opening direction by the fuel pressure in the control pressure chamber, and the fuel can be injected inappropriately.

Moreover, the abrupt change of the fuel pressure, which is caused by the fuel injection, can generate a shock wave that propagates in a fuel supply pipe at the velocity of sound. Then, the reflected wave of the shock wave can cause pulsation of the fuel pressure in the fuel supply pipe. In the conventional fuel injection valve, the check valve keeps closing even when fuel supply pressure is temporarily decreased due to such a pulsation. Thereby, the fuel pressure in the control pressure chamber can become relatively larger than the fuel pressure in the injection pressure chamber and in the back pressure chamber, and the fuel can be injected regardless of the operation of the piezoelectric actuator.

As in JP9-170514A corresponding to U.S. Pat. No. 5,752,486, in such a case that the narrow passage is provided at the point where the common rail and the fuel passage is connected to inhibit the pulsation of the fuel pressure, it is possible to avoid the influence of the pulsation in the high-pressure fuel supply passage. However, this construction can decrease actual fuel injection pressure because of pressure decrease at the narrow passage.

SUMMARY OF THE INVENTION

The present invention is made in view of the above-mentioned problem. Thus, it is an objective of the present invention to provide a regulating check valve that connects two passages to each other or disconnects the passages from each other at desired pressures, and also relates to a fuel injection valve for injecting fuel into an internal combustion engine, which has the regulating check valve and can prevent erroneous fuel injection that is caused by the pressure drop just after fuel injection or is caused by the pulsation of the fuel pressure in the fuel supply passage to inject the fuel with high accuracy.

To achieve the objective of the present invention, there is provided a regulating check valve for being installed in a fluid passage, which communicates a first flow passage to a second flow passage, to open or close the fluid passage. The regulating check valve has a valve body, a valve element and a spring. The valve body has a valve chamber, a first communicating hole, a second communicating hole and a valve seat. The first communicating hole communicates the valve chamber with the first flow passage. The second communicating hole communicates the valve chamber with the second flow passage. The valve seat is formed on an inner surface of the valve chamber and surrounds one end of the first communicating hole. The valve element is slidably installed in the valve chamber. The valve element has a seating portion that seats on or lifts away from the valve seat to close or open the first communicating hole. The valve element is urged by a pressure in the first flow passage in a valve-opening direction to lift the seating portion away from the valve seat, and is urged by a pressure in the second flow passage in a valve-closing direction to seat the seating portion on the valve seat. The spring is interposed between the valve element and the valve body. The spring urges the valve element in the valve-opening direction.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Figure 1:
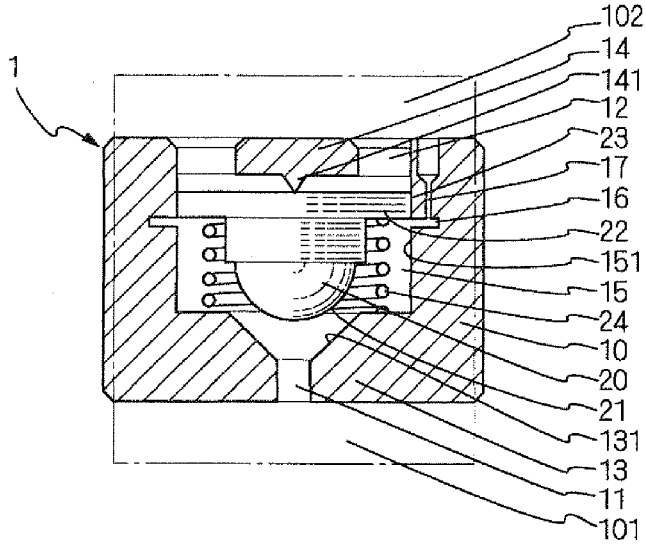
FIG. 1 is a cross-sectional view showing a regulating check valve according to a first embodiment of the present invention.

A construction of a regulating check valve 1 according to a first embodiment of the present invention will be described hereafter with reference to FIG. 1. FIG. 1 is a cross-sectional view showing the construction of the regulating check valve 1.

The regulating check valve 1 is installed in pressure fluid equipment that has two flow passages in which fluid flows and the pressure of the fluid changes. Specifically, the regulating check valve 1 is placed in a communicating passage that communicates a first flow passage 101 to a second flow passage 102. The regulating check valve 1 opens the first flow passage 101 to the second flow passage 102 or blocks the first flow passage 101 from the second flow passage 102 in accordance with changes of the pressures in the first and second flow passages 101, 102.

When the pressure $P_2$ in the second flow passage 102 is equal to or smaller than the pressure $P_1$ in the first flow passage 101, or when a difference $(P_2-P_1)$ between the pressure $P_2$ in the second flow passage 102 and the pressure $P_1$ in the first flow passage 101 is equal to or smaller than a predetermined pressure $(-K\cdot X/A)$ that will be described later, the regulating check valve 1 keeps opening. Thus, the regulating check valve 1 opens the first flow passage 101 to the second flow passage 102, to let the fluid flow from high pressure side of the first and second flow passages 101, 102 to low pressure side of the first and second flow passages 101, 102. Thereby, the regulating check valve 1 can rapidly equalize the pressure $P_1$ in the first flow passage 101 and the pressure $P_2$ in the second flow passage 102 with each other.

When the difference $(P_2-P_1)$ between the pressure $P_2$ in the second flow passage 102 and the pressure $P_1$ in the first flow passage 101 is larger than the predetermined pressure $(-K\cdot X/A)$, the regulating check valve 1 closes. Thus, the regulating check valve 1 blocks the first flow passage 101 from the second flow passage 102, to prevent the fluid from flowing from the second flow passage 102 to the first flow passage 101.

That is, the regulating check valve 1 according to the present invention functions as a regulating valve, which opens the first flow passage 101 to the second flow passage 102 to adjust the pressures in the first and second flow passages 101, 102 to a desired pressure, and also functions as a check valve, which blocks the first flow passage 101 from the second flow passage 102, in accordance with the changes of the pressures in the first and second flow passages 101, 102.

As shown in FIG. 1, the regulating check valve 1 has a valve body 10, a valve element 20 and a spring 24. A valve seat 131 is formed on the valve body 10.

The valve body 10 has a bottomed cylindrical shape. An inner circumferential wall 151 of the valve body 10 slidably supports the valve element 20 and defines a valve chamber 15 therein. A first communicating hole 11 is bored in a bottom portion 13 of the valve body 10. The first communicating hole 11 opens to the first flow passage 101. The valve seat 131 is formed on the bottom portion 13 of the valve body 10. The valve seat 131 is conically recessed toward the first flow passage 101. A second communicating hole 12 is formed in the valve body 10 to oppose to the bottom portion 13. The second communicating hole 12 opens to the second flow passage 102. The first communicating hole 11 is communicated to the second communicating hole 12 via the valve chamber 15.

A first communicating hole 11 side portion of the valve element 20 has a seating portion 21. The seating portion 21 has a hemispherical shape that can close the first communicating hole 11 when it seats on the valve seat 131. A second communicating hole 12 side portion of the valve element 20 has a flange portion 22 that protrudes radially outward. A side surface 23 of the flange portion 22 is slidably supported by the inner circumferential wall 151 of the valve chamber 15.

The spring 24 is interposed between the bottom portion 13 of the valve body 10 and the flange portion 22 of the valve element 20. The spring 24 is a coil spring, and pushes the flange portion 22 in a direction to urge the valve element 20 away from the valve seat 131.

A second flow passage 102 side portion of the valve body 10 has a holding portion 14 that holds the valve element 20 inside the valve body 10. The spring 24 pushes the valve element 20 toward the second flow passage 102 to bring a top surface of the flange portion 22 in contact with the holding portion 14.

In the first embodiment, a bottom surface of the holding portion 14 or the top surface of the flange portion 22 has a protrusion 141 so that the holding portion 14 can come in contact with the flange portion 22 at a point. Thereby, the pressure P2 in the second flow passage 102 acts on a whole surface of the flange portion 22.

Furthermore, the valve body 10 has an annular groove 16 on the inner circumferential wall 151. Specifically, a part of the inner circumferential wall 151 is recessed radially outward to provide the annular groove 16 at a height slightly lower than a position of a bottom surface of the flange portion 22 when the flange portion 22 is in contact with the holding portion 14. The valve body 10 has a third communicating hole 17 that communicates the annular groove 16 to the second flow passage 102. It is desirable that the third communicating hole 17 is a flow rate restricting narrow passage having a small diameter portion.

An arrangement and a dimension of the annular groove 16 is such that the annular groove 16 is blocked by the side surface 23 of the flange portion 22 when the seating portion 21 of the valve element 20 is in contact with the valve seat 131.

Figure 2A:
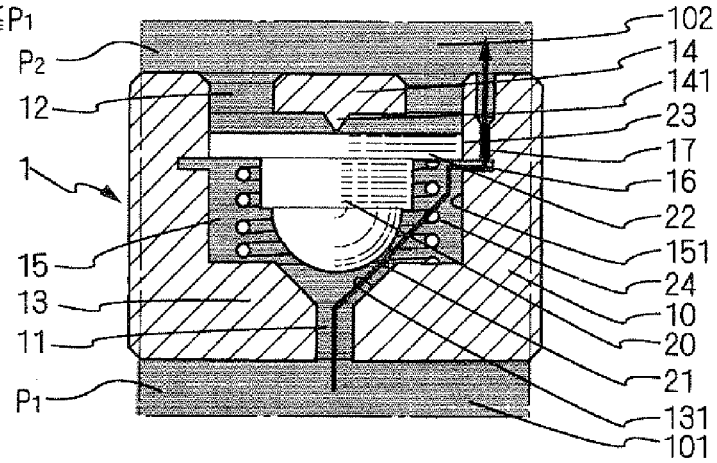
FIGS. 2A-2C are cross-sectional views showing actions of the regulating check valve according to the first embodiment.
Figure 2B:
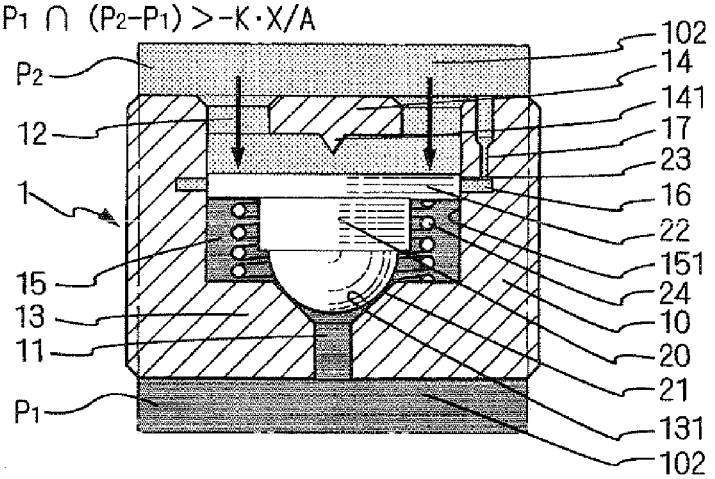
Figure 2C:
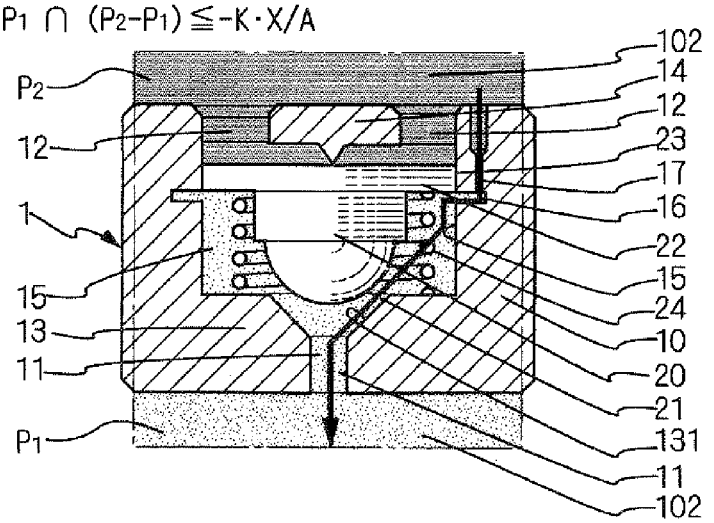

Actions of the regulating check valve 1 according to the first embodiment will be described hereafter with reference to FIGS. 2A-2C. FIGS. 2A-2C are cross-sectional views showing the actions of the regulating check valve 1 in accordance with the changes of the pressure $P_1$ in the first flow passage 101 and the pressure $P_2$ in the second flow passage 102.

As shown in FIG. 2A, when the pressure $P_2$ in the second flow passage 102 is equal to or smaller than the pressure $P_1$ in the first flow passage 101 (when $P_2 \leqq P_1$), the spring 24 urges the valve element 20 in a valve-opening direction. Thereby, the seating portion 21 is separated from the valve seat 131, and the first flow passage 101 is communicated to the second flow passage 102 via the first communicating hole 11, the annular groove 16 and the third communicating hole 17. Accordingly, the regulating check valve 1 functions as a regulating valve that equalizes the pressure $P_1$ in the first flow passage 101 with the pressure $P_2$ in the second flow passage 102.

As shown in FIG. 2B, when the pressure $P_2$ in the second flow passage 102 is larger than the pressure $P_1$ in the first flow passage 101 and the difference $(P_2-P_1)$ between the pressures $P_2$, $P_1$ is larger than the predetermined pressure $(-K \cdot X/A)$, the pressure $P_2$ in the second flow passage 102, which is acting on the flange portion 22, pushes the valve element 20 downward against an urging force of the spring 24. Here, K denotes a spring constant of the spring 24, X denotes a displacement of the spring 24 from its natural length, and A denotes a pressure receiving area on the flange portion 22. Thereby, the seating portion 21 seats on the valve seat 131 to close the first communicating hole 11, and the side surface 23 of the flange portion 22 closes the annular groove 16. Thus, the high-pressure fluid is prevented from flowing from the third communicating hole 17 into the valve chamber 15. Accordingly, the regulating check valve 1 functions as a check valve that blocks the first flow passage 101 from the second flow passage 102, and maintains the pressure $P_1$ in the first flow passage 101 and the pressure $P_2$ in the second flow passage 102 respectively.

As shown in FIG. 2C, when the pressure $P_2$ in the second flow passage 102 is larger than the pressure $P_1$ in the first flow passage 101 and the difference $(P_2-P_1)$ between the pressures $P_2$, $P_1$ is equal to or smaller than the predetermined pressure $(-K \cdot X/A)$, the pressure $P_2$ in the second flow passage 102 does not push the valve element 20 downward, and the first flow passage 101 is kept communicated to the second flow passage 102. Accordingly, the regulating check valve 1 functions as a regulating valve, and the fluid in the second flow passage 102 flows into the first flow passage 101 until the pressure $P_1$ in the first flow passage 101 is equalized with the pressure $P_2$ in the second flow passage 102.

Conventional check valve lets fluid flow in a forward direction and prevents the fluid from flowing in a reverse direction at all times. In contrast, the regulating check valve 1 according to the present invention lets the fluid flow in a forward direction at all times, lets the fluid flow in a reverse direction when the differential pressure is smaller than a predetermined value, and prevents the fluid from flowing in the reverse direction when the differential pressure is larger than the predetermined value.

Figure 3A:
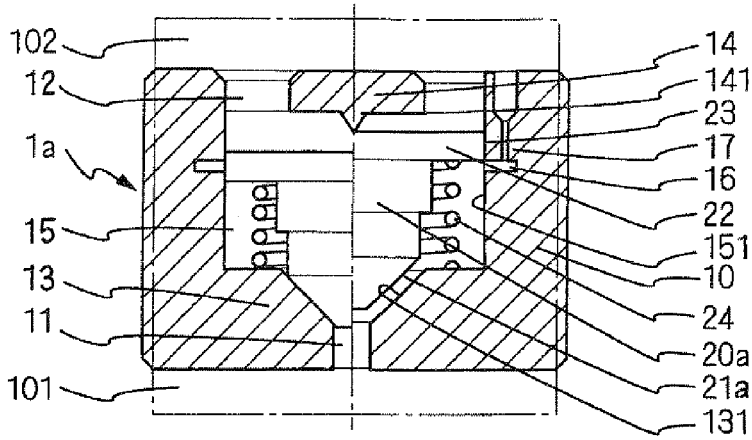
FIG. 3A is a cross-sectional view showing a regulating check valve according to a second embodiment of the present invention.
Figure 3B:
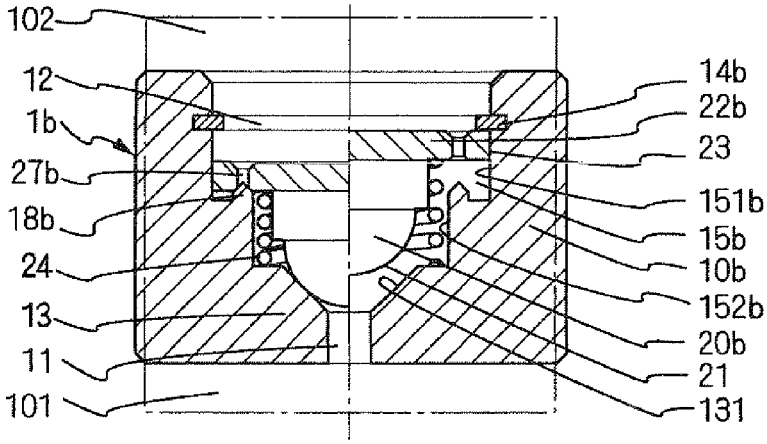
FIG. 3B is a cross-sectional view showing a regulating check valve according to a third embodiment of the present invention.
Figure 3C:
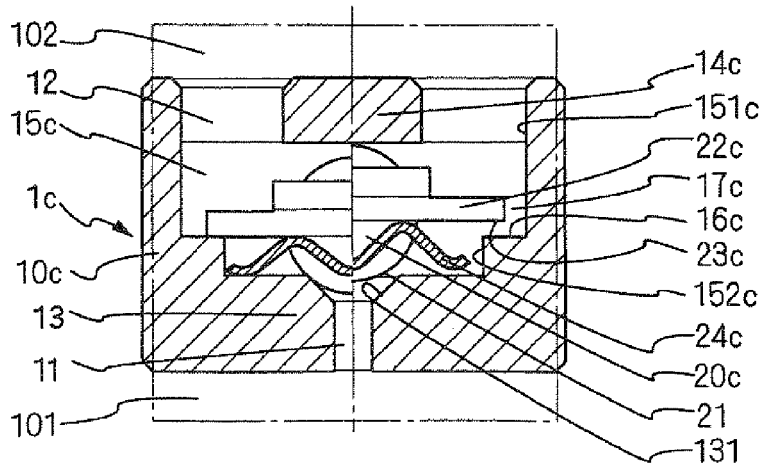
FIG. 3C is a cross-sectional view showing a regulating check valve according to a fourth embodiment of the present invention.

FIGS. 3A, 3B, 3C show regulating check valves 1*a*, 1*b*, 1*c* according to second, third and fourth embodiments of the present invention, respectively. Right halves of FIGS. 3A-3C show the regulating check valves 1*a*-1*c* in valve-opening states, and left halves of FIGS. 3A-3C show the regulating check valves 1*a*-1*c* in valve-closing states. In the second to fourth embodiments, only differences from the above-described first embodiment will be described.

In the first embodiment, the seating portion 21 of the valve element 20 has a hemispherical shape. In contrast, in the regulating check valve 1*a* according to the second embodiment shown in FIG. 3A, a seating portion 21*a* of a valve element 20*a* has an approximately conical shape. By forming the seating portion 21*a* in the approximately conical shape, a clearance between the seating portion 21*a* and the valve seat 131 becomes smaller than that in the first embodiment. Thereby, velocity of flow of the fluid through the clearance becomes faster by drawing effect. Accordingly, the regulating check valve 1*a* according to the second embodiment has an advantage that it has more fine response, in addition to the advantages of the regulating check valve 1 according to the first embodiment.

In the first embodiment, the third communicating hole 17 and the annular groove 16 are formed in the valve body 10. In contrast, in the regulating check valve lb according to the third embodiment shown in FIG. 3B, a third communicating hole 27*b* is bored in a flange portion 22*b* of a valve element 20*b*. A part of an inner circumferential wall 151*b* of a valve chamber 15*b* in a valve body 10*b* is narrowed radially inward to provide a small diameter portion 152*b*. A valve portion 18*b* is formed on a step between the inner circumferential wall 151*b* and the small diameter portion 152*b*. The valve portion 18*b* opens or closes the third communicating hole 27*b*. In the first embodiment, the holding portion 14 is formed in a lid-like shape. In contrast, in the regulating check valve 1*b* according to the third embodiment shown in FIG. 3B, a part of the inner circumferential wall 151*b* is extended radially outward to provide an annular groove, and a snap ring 14*b* is fitted to the annular groove. The snap ring 14*b* comes into engagement with an outer circumferential edge of the flange portion 22*b* to hold the valve element 20*b*. This construction provides substantially the same effect as in the first embodiment. FIG. 3B shows an example in which the valve portion 18*b* has a conical shape and the valve portion 18*b* comes in contact with a bottom end of the third communicating hole 27*b*. Alternatively, the valve portion 18*b* may be formed in a cylindrical shape that can be inserted into the third communicating hole 27*b* in a valve-closing time.

In the first embodiment, the third communicating hole 17 and the annular groove 16 are formed in the valve body 10. In contrast, in the regulating check valve 1*c* according to the fourth embodiment shown in FIG. 3C, a clearance is formed between a flange portion 22*c* of a valve element 20*c* and an inner circumferential wall 151*c* of a valve chamber 15*c* in a valve body 10*c* to provide a third communicating hole 17*c*. A part of the inner circumferential wall 151*c* is narrowed radially inward to provide a small diameter portion 152*c*. A bottom surface 23*c* of the flange portion 22*c* comes in contact with a top surface 16*c* of a step between the inner circumferential wall 151*c* and the small diameter portion 152*c* to close the third communicating hole 17*c*. In the first embodiment, a coil spring is used as the spring 24. In contrast, in the fourth embodiment, a waved washer spring is used as a spring 24*c*. In the first embodiment, the holding portion 14 is provided with the protrusion 141. In contrast, in the fourth embodiment, the flange portion 22*c* is formed in a shape such that a ball-like body of the valve element 20*c*, which serves as the seating portion 21, partially protrudes upward from a top surface of the flange portion 22*c* to come in point contact with a bottom surface of a holding portion 14*c*. The construction of the fourth embodiment provides substantially the same effect as in the first embodiment.

Figure 4:
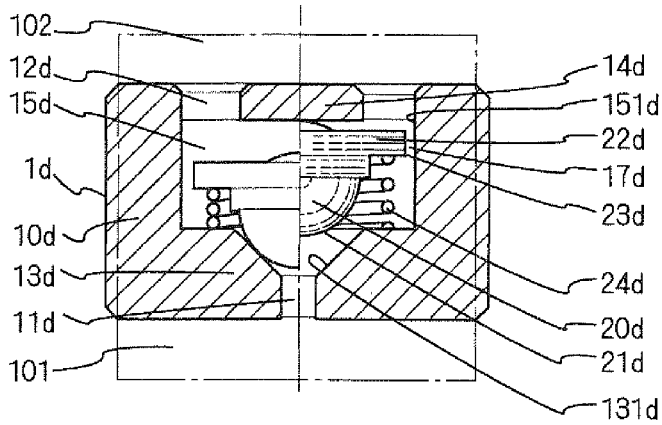
FIG. 4 is a cross-sectional view showing a regulating check valve according to a fifth embodiment of the present invention.

FIG. 4 shows a regulating check valve 1*d* according to a fifth embodiment of the present invention. In the above-described embodiments, the second flow passage 102 is communicated to the first flow passage 101 via the third communicating hole 17, 27*b*, 17*c* to secure differential pressure for the operation of the regulating check valve 1, 1*a*-1*c* and to secure pressure regulating accuracy of the regulating check valve 1, 1*a*-1*c*. Alternatively, as shown in FIG. 4, in such a case that the difference between the pressure in the first flow passage 101 and the pressure in the second flow passage 102 is relatively large, it is possible to form a clearance between a side surface 23*d* of a flange portion 22*d* of a valve element 20*d* and an inner circumferential wall 151*d* of a valve body 10*d*, and to let the clearance serve as a third communicating hole 17*d*. Thereby, it is possible to eliminate a construction that closes or opens the third communicating hole 17*d* in synchronization with seating or lifting action of the valve element 20*d*.

The valve body 10*d* has a bottomed cylindrical shape. The inner circumferential wall 151*d* movably supports the valve element 20*d* and defines a valve chamber 15*d* therein. A first communicating hole 11*d* is bored in a bottom portion 13*d* of the valve body 10*d*. The first communicating hole 11*d* opens to the first flow passage 101. A valve seat 131*d* is formed on the bottom portion 13*d* of the valve body 10*d*. The valve seat 131*d* is conically recessed toward the first flow passage 101. A second communicating hole 12*d* is formed in the valve body 10*d* to oppose to the bottom portion 13*d*. The second communicating hole 12*d* opens to the second flow passage 102. The first communicating hole 11*d* is communicated to the second communicating hole 12*d* via the valve chamber 15*d*.

A first communicating hole 11*d* side portion of the valve element 20*d* has a seating portion 21*d*. The seating portion 21*d* has a hemispherical shape that can close the first communicating hole 11*d* when it seats on the valve seat 131*d*. A second communicating hole 12*d* side portion of the valve element 20*d* has the flange portion 22*d* that protrudes radially outward. A side surface 23*d* of the flange portion 22*d* is movably retained in the inner circumferential wall 151*d* in such a manner that a gap is formed between a side surface 23*d* of the flange portion 22*d* and the inner circumferential wall 151*d* of the valve chamber 15*d*.

A spring 24*d* is interposed between the bottom portion 13*d* of the valve body 10*d* and the flange portion 22*d* of the valve element 20*d*. The spring 24*d* is a coil spring, and pushes the flange portion 22*d* in a direction to urge the valve element 20*d* away from the valve seat 131*d*.

A second flow passage 102 side portion of the valve body 10*d* has a holding portion 14*d* that holds the valve element 20*d* inside the valve body 10*d*. The spring 24*d* pushes the valve element 20*d* toward the second flow passage 102, to bring a protruding portion of the valve element 20*d* in contact with the holding portion 14*d*.

According to the fifth embodiment, when the pressure $P_2$ in the second flow passage 102 is much larger than the pressure $P_1$ in the first flow passage 101 and a pressure $A_S \cdot (P_2 - P_1)$ that acts on a cross-sectional area $A_S$ of the seating portion 21*d* is larger than a spring load ($-K \cdot X/A$) of the spring 24*d* that urges the valve element 20*d* in a valve-opening direction, the seating portion 21*d* seats on the valve seat 131*d* to close the first communicating hole 11*d*. Accordingly, the construction of the fifth embodiment provides substantially the same effect as in the first to fourth embodiments.

In the fifth embodiment, it is desirable that the clearance that serves as the third communicating hole 17*d* is sufficiently small with respect to a cross-sectional area of the first communicating hole 11*d*.

The regulating check valve according to the present invention is not limited to the constructions of the above-described embodiments. For example, the regulating check valve may have a construction in which points of differences across the above-described embodiments such as the shape of the spring are adequately combined.

Figure 5:
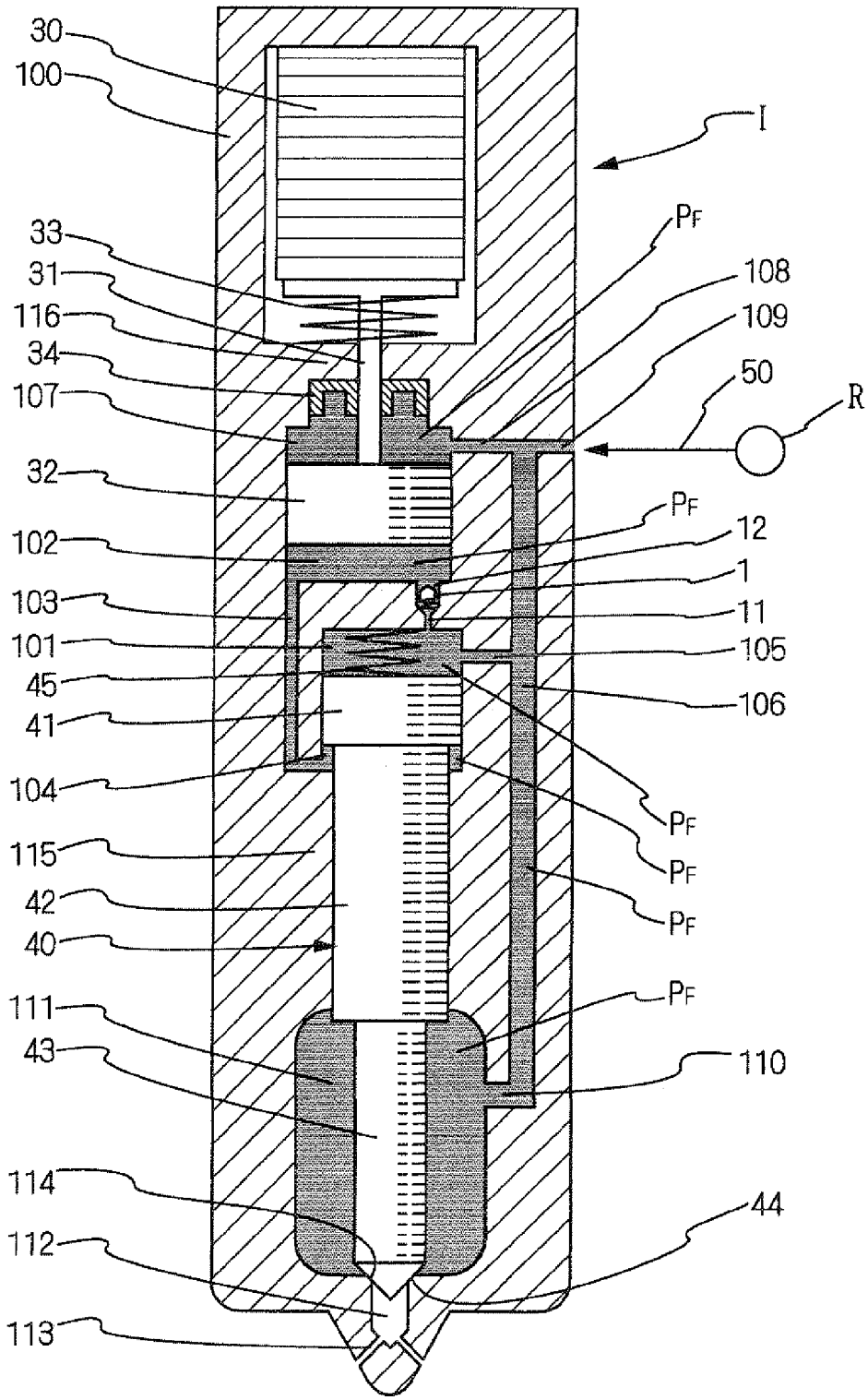
FIG. 5 is a cross-sectional view showing a fuel injection valve according to a sixth embodiment of the present invention in a state where injection holes are closed.

A fuel injection valve I according to a sixth embodiment of the present invention will be described hereafter with reference to FIG. 5. FIG. 5 schematically shows a construction of the fuel injection valve I in a valve-closing time.

The fuel injection valve I has a nozzle body 100, the regulating check valve 1 (1*a*-1*d*) according to the present invention, a piezoelectric actuator 30 and a needle 40. The fuel injection valve I is mounted on an internal combustion engine (not shown). High-pressure fuel that is accumulated in a common rail R at a high pressure of 30 MPa, for example, is introduced into the fuel injection valve I via a high-pressure fuel supply pipe 50. By driving the piezoelectric actuator 30, the needle 40 moves upward or downward, to open or close injection holes 113 that are formed on a tip end of the nozzle body 100. In such a manner, injection of the high-pressure fuel into the internal combustion engine is started or stopped.

In the following descriptions, the upper side in the drawings is referred to as proximal end side, and the lower side in the drawings is referred to as distal end side. The upward direction in the drawings is referred to as valve-opening direction, and the downward direction in the drawings is referred to as valve-closing direction.

The fuel injection valve I slidably supports the needle 40 in the nozzle body 100 that is formed in an approximately cylindrical shape.

The needle 40 is formed in a stepped cylindrical shape. A middle diameter portion 42 of the needle 40 is slidably supported by a needle sliding portion 115 that is formed in the nozzle body 100.

A large diameter portion 41 is formed on a proximal end side of the middle diameter portion 42. The large diameter portion 41 has a larger diameter than the middle diameter portion 42. A small diameter portion 43 is formed on a distal end side of the middle diameter portion 42. The small diameter portion 43 has a smaller diameter than the middle diameter portion 42. An approximately conical seating portion 44 is formed on a distal end side of the small diameter portion 43.

The nozzle body 100 slidably supports the large diameter portion 41 of the needle 40. A back pressure chamber 101 is defined on a proximal end side of the large diameter portion 41. The pressure in the back pressure chamber 101 applies a force on a rear surface of the needle 40 in the valve-closing direction. A control chamber 104 is defined on a distal end side of the large diameter portion 41. The pressure in the control chamber 104 applies a force on a bottom surface of the large diameter portion 41 in the valve-opening direction.

The high-pressure fuel is introduced from a high-pressure fuel introducing hole 109 to a high-pressure fuel passage 106, and a back pressure introducing passage 105 introduces a part of the high-pressure fuel from the high-pressure fuel passage 106 into the back pressure chamber 101.

A valve-closing spring 45 is installed in the back pressure chamber 101. The valve-closing spring 45 urges the needle 40 in the valve-closing direction.

The piezoelectric actuator 30 is housed in and fixed to a proximal end portion of the nozzle body 100. The piezoelectric actuator 30 extends or contracts by being charged or discharged. An actuator head 31 is slidably supported by a partition wall 116 of the nozzle body 100. The actuator head 31 transmits a displacement of the piezoelectric actuator 30 to a pressurizing piston 32. A piston return spring 33 urges the actuator head 31 in the valve-opening direction. A proximal end side of the actuator head 31 is in contact with the piezoelectric actuator 30. The pressurizing piston 32 is fixed to a distal end of the actuator head 31 so that the pressurizing piston 32 can move integrally with the actuator head 31.

The pressurizing piston 32 is formed in an approximately cylindrical shape, and is slidably supported in the nozzle body 100.

A balancing chamber 107 is defined on a proximal end side of the pressurizing piston 32. The pressure in the balancing chamber 107 applies a balancing counter force on the pressurizing piston 32 in the valve-closing direction. A pressurizing chamber 102 is defined on a distal end side of the pressurizing piston 32. The pressure in the pressurizing chamber 102 increases or decreases in accordance with a downward movement or an upward movement of the pressurizing piston 32.

A balancing pressure introducing passage 108 introduces a part of the high-pressure fuel from the high-pressure fuel passage 106 into the balancing chamber 107.

A seal member 34 is fitted to a proximal end side of the balancing chamber 107. The seal member 34 slidably supports the actuator head 31 and keeps an oiltightness to prevent the high-pressure fuel from leaking into an installation chamber in which the piezoelectric actuator 30 is installed.

The pressurizing chamber 102 is communicated to the back pressure chamber 101 via the regulating check valve 1, which is a principal part of the present invention. The high-pressure fuel that is introduced into the back pressure chamber 101 is led into the pressurizing chamber 102 via the regulating check valve 1.

The back pressure chamber 101 in the sixth embodiment corresponds to the first flow passage in the first to fifth embodiments, and the pressurizing chamber 102 in the sixth embodiment corresponds to the second flow passage in the first to fifth embodiments. The first communicating hole 11 of the regulating check valve 1 opens to the back pressure chamber 101, and the second communicating hole 12 opens to the pressurizing chamber 102.

The pressure of the high-pressure fuel introduced into the balancing chamber 107 acts on the pressurizing piston 32 in the valve-closing direction. The pressure of the high-pressure fuel introduced into the pressurizing chamber 102 acts on the pressurizing piston 32 in the valve-opening direction. Thereby, the extension of the piezoelectric actuator 30 securely makes the pressure in the pressurizing chamber 102 larger than the introducing pressure of the high-pressure fuel.

Furthermore, a pressure transmitting passage 103 is formed in the nozzle body 100. The pressure transmitting passage 103 communicates the pressurizing chamber 102 to the control chamber 104. The pressure in the control chamber 104 acts on the needle 40 in the valve-opening direction. The volume of the pressurizing chamber 102 changes in accordance with the displacement of the piezoelectric actuator 30, and the volume of the control chamber 104 changes in accordance with a change of the volume of the pressurizing chamber 102. In this regard, a cross-sectional area of the pressurizing chamber 102 is much larger than a cross-sectional area of the control chamber 104. Thereby, an axial displacement of the control chamber 104 is greatly magnified from the displacement of the piezoelectric actuator 30. Accordingly, it is possible to displace the large diameter portion 41 of the needle 40 largely.

A fuel accumulating chamber 111 is defined around the small diameter portion 43. The fuel accumulating chamber 111 accumulates the high-pressure fuel that is introduced thereinto from the high-pressure fuel passage 106 via a high-pressure fuel supply passage 110.

The injection holes 113 are bored on the distal end of the nozzle body 100. The injection holes 113 open to a sac chamber 112 that is communicated with the fuel accumulating chamber 111. The seating portion 44 of the needle 40 seats on a needle seat 114 or lifts away from the needle seat 114 to close or open the injection holes 113.

A laminated piezoelectric element is used as the piezoelectric actuator 30. The laminated piezoelectric element includes piezo-ceramic layers that are made of piezo-ceramic material such as PZT. Each piezo-ceramic layer is polarized in its thickness direction. In the laminated piezoelectric element, several tens to several hundreds of the piezo-ceramic layers are laminated to change the polarized direction alternately.

As shown in FIG. 5, the piezoelectric actuator 30 is contracted in the valve-closing time. Both of the pressure $P_1$ in the back pressure chamber 101, which serves as the first flow passage, and the pressure $P_2$ in the pressurizing chamber 102, which serves as the second flow passage, are equal to a standard supply pressure $P_F$ at which the high-pressure fuel is supplied from the common rail R. Therefore, the regulating check valve 1 is opened. At this time, the pressure $P_B$ in the balancing chamber 107, the pressure $P_2$ in the pressurizing chamber 102, the pressure in the control chamber 104, the pressure $P_1$ in the back pressure chamber 101 and the pressure in the fuel accumulating chamber 111 are respectively equal to the standard supply pressure $P_F$. Thereby, the fuel pressure acting on the needle 40 in the valve-opening direction balances with the fuel pressure acting on the needle 40 in the valve-closing direction, and the spring load of the valve-closing spring 45 urges the needle 40 in the valve-closing direction, so that the fuel injection valve I maintains a valve-closing state.

Figure 6:
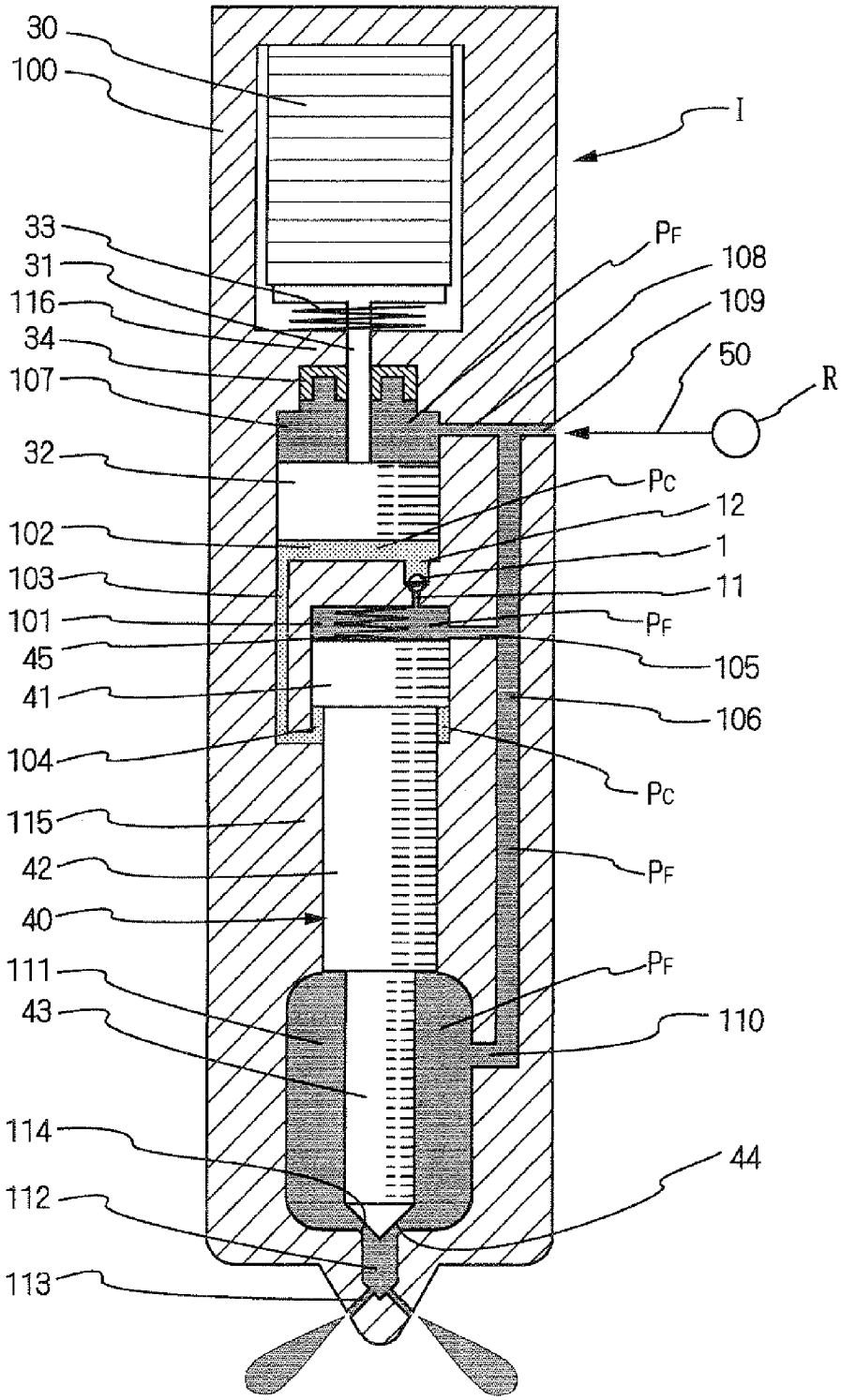
FIG. 6 is a cross-sectional view showing the fuel injection valve according to the sixth embodiment in a state where the injection holes are opened.

A state of the fuel injection valve I in a valve-opening time will be described hereafter with reference to FIG. 6.

When the piezoelectric actuator 30 is electrically energized, the piezoelectric actuator 30 extends and pushes the actuator head 31 downward. Then, the pressurizing piston 32 increases the pressure $P_2$ in the pressurizing chamber 102 in accordance with the downward movement of the actuator head 31. At this time, the pressure $P_2$ in the pressurizing chamber 102 is at a compressing pressure $P_C$ that is larger than a summation of the pressure $P_1$ in the back pressure chamber 101 and the spring load (−K·X/A) of the spring 24, 24*c* of the regulating check valve 1. Thus, the regulating check valve 1 is closed.

Therefore, even when the pressure $P_2$ in the pressurizing chamber 102 is at the compressing pressure $P_C$ that is larger than the pressure $P_1$ in the back pressure chamber 101, the fuel is prevented from flowing from the pressurizing chamber 102 into the back pressure chamber 101, so that the pressure $P_1$ in the back pressure chamber 101 is kept at the standard supply pressure $P_F$.

In contrast, the pressure $P_2$ in the pressurizing chamber 102 is transmitted to the control chamber 104 via the pressure transmitting passage 103, and the pressure in the control chamber 104 also increases.

In accordance with the increase of the pressure in the control chamber 104, the needle 40 moves upward against the spring load of the valve-closing spring 45. Then, the seating portion 44 lifts away from the needle seat 114, and the high-pressure fuel in the fuel accumulating chamber 111 flows through the sac chamber 112 and is injected out of the injection holes 113 into the internal combustion engine (not shown).

Figure 7:
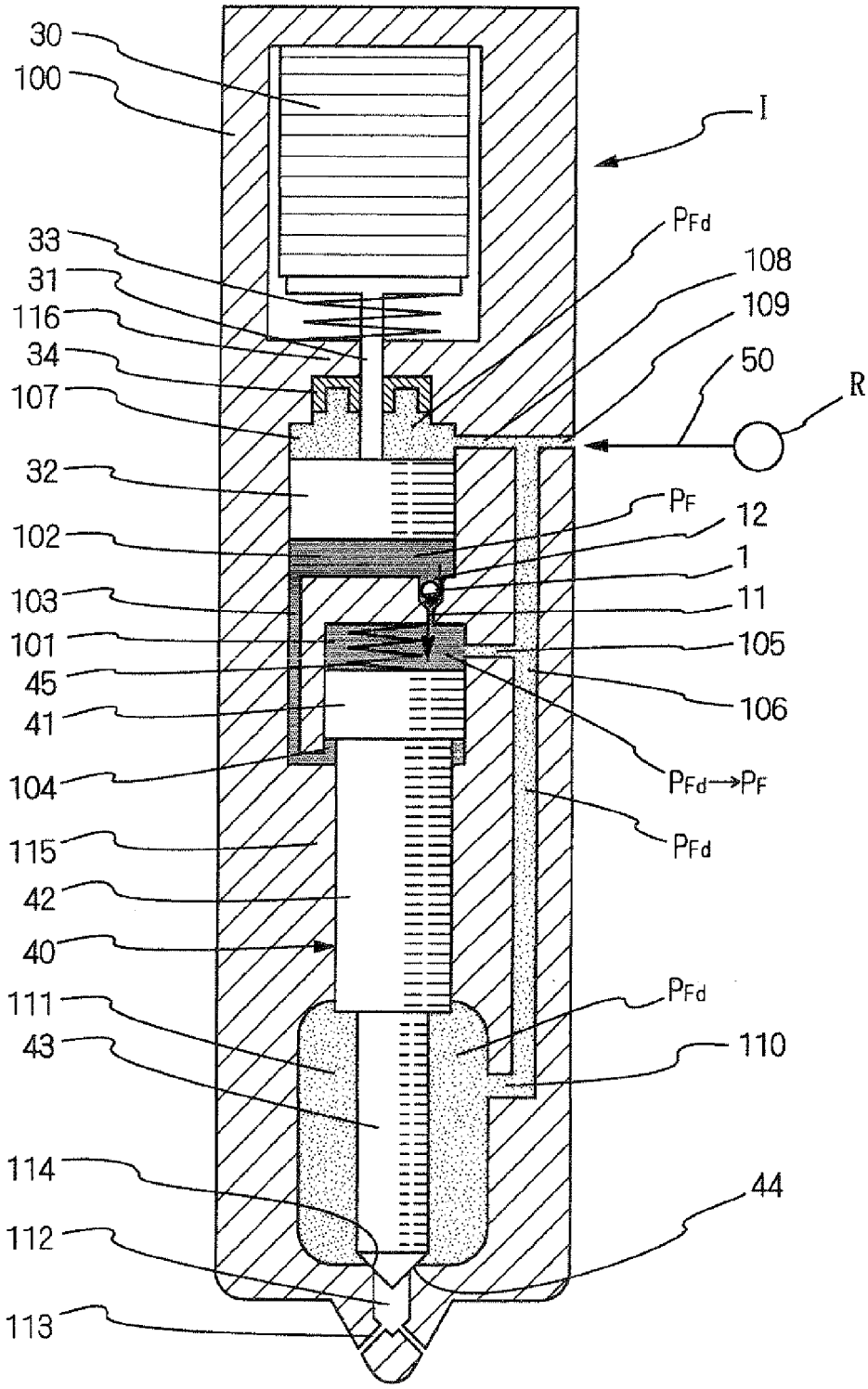
FIG. 7 is a cross-sectional view showing the fuel injection valve according to the sixth embodiment in a state where the injection holes are closed due to an abrupt pressure drop.

The effect of the fuel injection valve I according to the present invention will be described hereafter with reference to FIG. 7. The advantages of the fuel injection valve I appear when the pressure of the high-pressure fuel abruptly drops just after the high-pressure fuel is injected from the fuel injection valve I and when the pressure of the fuel in the high-pressure fuel supply pipe 50 decreases due to pressure pulsation, At a time just after the high-pressure fuel is injected from the fuel injection valve I, or when the pressure of the fuel in the high-pressure fuel supply pipe 50 decreases due to pressure pulsation, all of the pressure in the high-pressure fuel passage 106, the pressure $P_B$ in the balancing chamber 107, the pressure $P_1$ in the back pressure chamber 101 and the pressure in the fuel accumulating chamber 111 are at a low pressure $P_{Fd}$.

In contrast, the pressure $P_2$ in the pressurizing chamber 102 and the pressure in the control chamber 104 returns from the compressing pressure $P_C$ to the standard supply pressure $P_F$ because the piezoelectric actuator 30 contracts and the pressurizing piston 32 is drawn upward. Thereby, the pressure in the control chamber 104 momentarily becomes larger than the pressure $P_1$ in the back pressure chamber 101, and the needle 40 can move upward. However, the difference between the pressure $P_2$ ($P_F$) in the pressurizing chamber 102 and the pressure $P_1$ ($P_{Fd}$) in the back pressure chamber 101 is smaller than the spring load of the spring 24, 24*c* of the regulating check valve 1, so that the regulating check valve 1 opens. Accordingly, the high-pressure fuel in the pressurizing chamber 102 rapidly flows into the back pressure chamber 101, and the pressure $P_1$ ($P_{Fd}$) in the back pressure chamber 101 becomes equal to the pressure $P_2$ ($P_F$) in the pressurizing chamber 102 and to the pressure in the control chamber 104. Therefore, even when the pressure in the high-pressure fuel passage 106, the pressure $P_B$ in the balancing chamber 107, the pressure $P_1$ in the back pressure chamber 101 and the pressure in the fuel accumulating chamber 111 abruptly drop, the needle 40 does not lift upward. Accordingly, the injection holes 113 are kept closed, and it is possible to prevent unintended fuel injections that can occur regardless of the actions of the piezoelectric actuator 30. Therefore, the fuel injection valve I can inject the fuel with quite high reliability.

Figure 8:
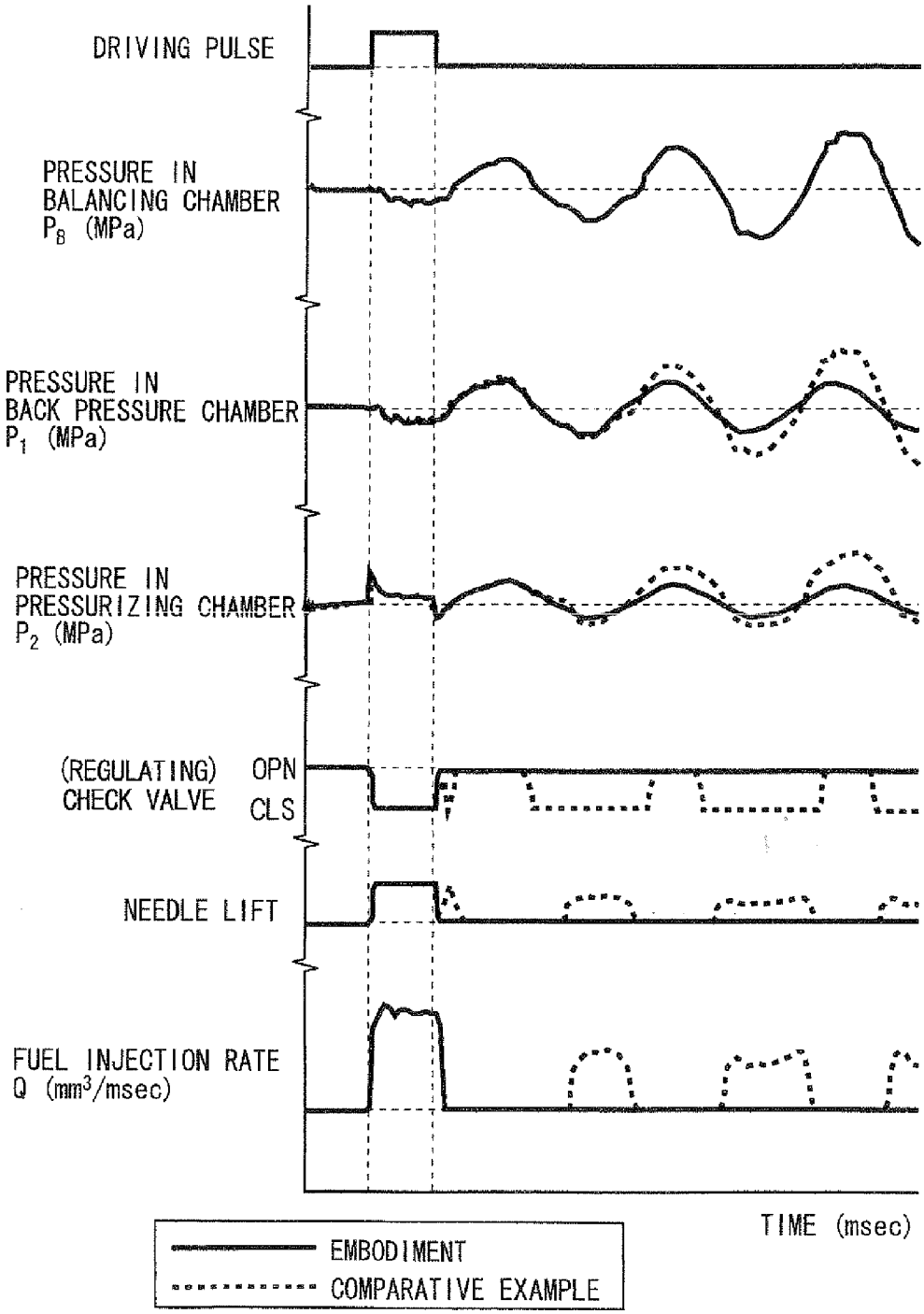
FIG. 8 is a time chart showing actions of the regulating check valve according to the sixth embodiment against actions of a regulating check valve of a comparative example.

FIG. 8 shows the actions of the fuel injection valve I according to the present invention with reference to a comparative example. Solid lines in the time chart of FIG. 8 show the actions of the fuel injection valve I according to the sixth embodiment of the present invention. Dotted lines in the time chart of FIG. 8 show actions of a fuel injection valve according to the comparative example that has a conventional check valve instead of the regulating check valve 1 (1*a*-1*d*) according to the present invention.

As shown in FIG. 8, in the fuel injection valve I according to the sixth embodiment, even when the pressure $P_B$ in the balancing chamber 107 fluctuates with a large amplitude due to a pressure pulsation of the high-pressure fuel in the high-pressure fuel supply pipe 50, the regulating check valve 1 keeps opening except when the piezoelectric actuator 30 is driving. When the pressure $P_1$ in the back pressure chamber 101 is higher than the pressure $P_2$ in the pressurizing chamber 102, the high-pressure fuel flows from the back pressure chamber 101 into the pressurizing chamber 102. When the pressure $P_1$ in the back pressure chamber 101 is lower than the pressure $P_2$ in the pressurizing chamber 102, the high-pressure fuel flows from the pressurizing chamber 102 into the back pressure chamber 101. Therefore, the fluctuation of the pressure $P_1$ in the back pressure chamber 101 and the fluctuation of the pressure $P_2$ in the pressurizing chamber 102 are smaller than the fluctuation of the pressure in the balancing chamber 107. Moreover, the difference between the pressure $P_1$ in the back pressure chamber 101 and the pressure $P_2$ in the pressurizing chamber 102 is small except when the pressure $P_2$ in the pressurizing chamber 102 is enlarged by the action of the piezoelectric actuator 30. Thus, unintentional lift of the needle 40 can be prevented. Therefore, the fuel injection rate Q rises only when the piezoelectric actuator 30 is driving.

In contrast, in the comparative example, the pressure $P_1$ in the back pressure chamber 101 fluctuates with a large amplitude due to the pressure pulsation of the high-pressure fuel as the pressure $P_B$ in the balancing chamber 107 fluctuates. In the conventional check valve, when the pressure $P_2$ in the pressurizing chamber 102 is higher than the pressure $P_1$ in the back pressure chamber 101, the injection holes 113 are closed regardless of the actions of the piezoelectric actuator 30. Therefore, when the pressure $P_2$ of the pressurizing chamber 102 is higher than the pressure $P_1$ of the back pressure chamber 101, the needle 40 lifts and the fuel is injected.

Therefore, the fuel injection valve I according to the sixth embodiment can prevent the unintentional fuel injections that can occur regardless of the actions of the piezoelectric actuator 30. Generally, in order to prevent the influence of pulsation of the fuel pressure in the high-pressure fuel supply pipe 50, a flow rate restricting narrow passage is placed at a connection between the high-pressure fuel introducing hole of the fuel injection valve and the high-pressure fuel supply pipe. However, by placing the flow rate restricting narrow passage at the connection between the fuel injection valve and the high-pressure fuel supply pipe, the fuel supply pressure is decreased in the flow rate restricting narrow passage, and the actual fuel injection pressure can be decreased.

By the fuel injection valve I that is provided with the regulating check valve 1 according to the present invention, a diameter of such a narrow passage can be extended or such a narrow passage itself can be eliminated. Therefore, it is possible to keep the actual fuel injection pressure at a high pressure. Accordingly, it is possible to promote atomization of the injected fuel further, to decrease the exhaust emission and to improve gas mileage.

The present invention is not limited to the above-described embodiments, but can be suitably modified within a range that is not deviated from the spirit of the present invention.

For example, the fuel injection valve of the present invention is not limited to a construction in which the high-pressure fuel is introduced directly into the fuel accumulating chamber as described in the above embodiments. For example, the present invention can be applied to a fuel injection valve having a construction in which the high-pressure fuel is introduced into the fuel accumulating chamber via an in-needle passage that is formed in the needle.

Additional advantages and modifications will readily occur to those skilled in the art. The invention in its broader terms is therefore not limited to the specific details, representative apparatus, and illustrative examples shown and described.

What is claimed is:

1. A regulating check valve for being installed in a fluid passage that communicates a first flow passage to a second flow passage to open or close the fluid passage, the regulating check valve comprising:

a valve body having a valve chamber, a first communicating hole that communicates the valve chamber with the first flow passage, a second communicating hole that communicates the valve chamber with the second flow passage and a valve seat that is formed on an inner surface of the valve chamber and surrounds one end of the first communicating hole;

a valve element that is slidably installed in the valve chamber, has a seating portion that seats on or lifts away from the valve seat to close or open the first communicating hole, wherein the valve element is urged by a pressure in the first flow passage in a valve-opening direction to lift the seating portion away from the valve seat and is urged by a pressure in the second flow passage in a valve-closing direction to seat the seating portion on the valve seat; and a spring that is interposed between the valve element and the valve body to urge the valve element in the valve-opening direction, wherein:

the valve body has an approximately cylindrical shape;

the valve seat has an approximately conical shape that is recessed toward the first flow passage;

the valve element has a flange portion that protrudes radially outward and is slidably supported by an inner circumferential wall of the valve body;

the spring is interposed between the flange portion of the valve element and the valve body;

the valve body has an annular groove on the inner circumferential wall;

the annular groove is closed by the flange portion when the seating portion is seating on the valve seat and is exposed to the valve chamber when the seating portion is lifting away from the valve seat; and the valve body has a third communicating hole that communicates the annular groove to the second flow passage.

2. The regulating check valve according to claim 1, wherein:

the seating portion has an approximately spherical shape.

3. The regulating check valve according to claim 1, wherein:

the seating portion has an approximately conical shape.

4. A regulating check valve for being installed in a fluid passage that communicates a first flow passage to a second flow passage to open or close the fluid passage, the regulating check valve comprising:

a valve body having a valve chamber, a first communicating hole that communicates the valve chamber with the first flow passage, a second communicating hole that communicates the valve chamber with the second flow passage and a valve seat that is formed on an inner surface of the valve chamber and surrounds one end of the first communicating hole;

a valve element that is slidably installed in the valve chamber, has a seating portion that seats on or lifts away from the valve seat to close or open the first communicating hole, wherein the valve element is urged by a pressure in the first flow passage in a valve-opening direction to lift the seating portion away from the valve seat and is urged by a pressure in the second flow passage in a valve-closing direction to seat the seating portion on the valve seat; and a spring that is interposed between the valve element and the valve body to urge the valve element in the valve-opening direction, wherein:

the valve body has an approximately cylindrical shape;

the valve seat has an approximately conical shape that is recessed toward the first flow passage;

the seating portion has an approximately spherical shape;

the valve element has a flange portion that protrudes radially outward and is slidably supported by an inner circumferential wall of the valve body;

the spring is interposed between the flange portion of the valve element and the valve body;

the flange portion of the valve element and the inner circumferential wall of the valve body provide a clearance therebetween; and a part of the inner circumferential wall is narrowed radially inward to provide a step that contacts with the flange portion to close the clearance when the seating portion is seating on the valve seat and is separated from the flange portion to open the clearance when the seating portion is lifting away from the valve seat.

5. A fuel injection valve comprising:

a nozzle body into which fuel is introduced;

an injection hole that is formed in the nozzle body to inject the fuel therefrom;

a needle that is slidably installed in the nozzle body to open or close the injection hole;

a pressurizing chamber that is defined in the nozzle body and receives the fuel therein to apply a pressure of the fuel on the needle in a direction to urge the needle to open the injection hole;

an actuator that extends or contracts by being charged or discharged to increase or decrease the pressure of the fuel in the pressurizing chamber;

a back pressure chamber that is defined in the nozzle body and receives the fuel to apply a pressure of the fuel on the needle in a direction to urge to needle to close the injection hole; and the regulating check valve according to claim 1, wherein:

the first communicating hole of the regulating check valve opens to the back pressure chamber; and the second communicating hole of the regulating check valve opens to the pressurizing chamber.

6. A fuel injection valve comprising:

a nozzle body into which fuel is introduced;

an injection hole that is formed in the nozzle body to inject the fuel therefrom;

a needle that is slidably installed in the nozzle body to open or close the injection hole;

a pressurizing chamber that is defined in the nozzle body and receives the fuel therein to apply a pressure of the fuel on the needle in a direction to urge the needle to open the injection hole;

an actuator that extends or contracts by being charged or discharged to increase or decrease the pressure of the fuel in the pressurizing chamber;

a back pressure chamber that is defined in the nozzle body and receives the fuel to apply a pressure of the fuel on the needle in a direction to urge to needle to close the injection hole; and the regulating check valve according to claim 5, wherein:

the first communicating hole of the regulating check valve opens to the back pressure chamber; and the second communicating hole of the regulating check valve opens to the pressurizing chamber.

* * * * *